United States Patent [19]

Rossi

[11] 4,224,488

[45] Sep. 23, 1980

[54] ELECTRICAL SWITCH DEVICES

[75] Inventor: Guglielmo Rossi, Stutensee-Friedrichstal, Fed. Rep. of Germany

[73] Assignee: Ranco Incorporated, Columbus, Ohio

[21] Appl. No.: 924,662

[22] Filed: Jul. 14, 1978

[30] Foreign Application Priority Data

Jul. 13, 1977 [GB] United Kingdom ..... 29381/77

[51] Int. Cl.[2] ..... H01H 21/04

[52] U.S. Cl. ..... 200/67 A; 200/67 DA; 200/251; 200/261

[58] Field of Search ..... 200/67 D, 67 DA, 251, 200/261, 138; 73/1

[56] References Cited

U.S. PATENT DOCUMENTS

| | | | |
|---|---|---|---|
| 2,170,767 | 8/1939 | Riche | 200/67 R |
| 2,505,605 | 4/1950 | Coake | 200/67 D |
| 2,859,608 | 11/1958 | Bear et al. | 73/1 |
| 2,985,738 | 5/1961 | Boak | 200/138 |
| 3,062,932 | 11/1962 | Korsgren, Sr. et al. | 200/67 D |
| 3,105,887 | 10/1963 | Korsgren, Sr. et al. | 200/67 D |
| 3,118,029 | 1/1964 | Yamamoto | 200/67 D |
| 3,187,132 | 6/1965 | Dennison | 200/67 D |
| 3,189,703 | 6/1965 | Chapin | 200/67 D |
| 3,244,848 | 4/1966 | Chapin et al. | 200/67 D X |
| 3,578,926 | 5/1971 | Obermann | 200/67 D |
| 3,634,801 | 1/1972 | Gould et al. | 200/67 D UX |
| 3,648,004 | 3/1972 | Williams, III | 200/67 D |
| 3,688,060 | 8/1972 | Risk | 200/67 D |
| 4,118,610 | 10/1978 | Purssell et al. | 200/67 AD |

FOREIGN PATENT DOCUMENTS

| | | | |
|---|---|---|---|
| 1276778 | 9/1968 | Fed. Rep. of Germany | 200/67 R |
| 2294529 | 9/1976 | France | 200/67 R |
| 327887 | 2/1958 | Switzerland | 200/67 R |

*Primary Examiner*—Henry K. Artis

*Attorney, Agent, or Firm*—Watts, Hoffmann, Fisher & Heinke Co.

[57] ABSTRACT

An electrical snap acting switch is calibrated by deforming an unsupported part of a terminal strip which carries a fixed contact after assembly of the switch device, to predetermine the operating point of the switch contacts. Deformation of the fixed contact support strip is facilitated by apertures in the strip on opposite sides of the fixed contact. These apertures also serve to ventilate the make and break zone of the contacts to assist in ozone dispersal from this zone, minimizing arcing.

8 Claims, 2 Drawing Figures

ELECTRICAL SWITCH DEVICES

Figure 1:
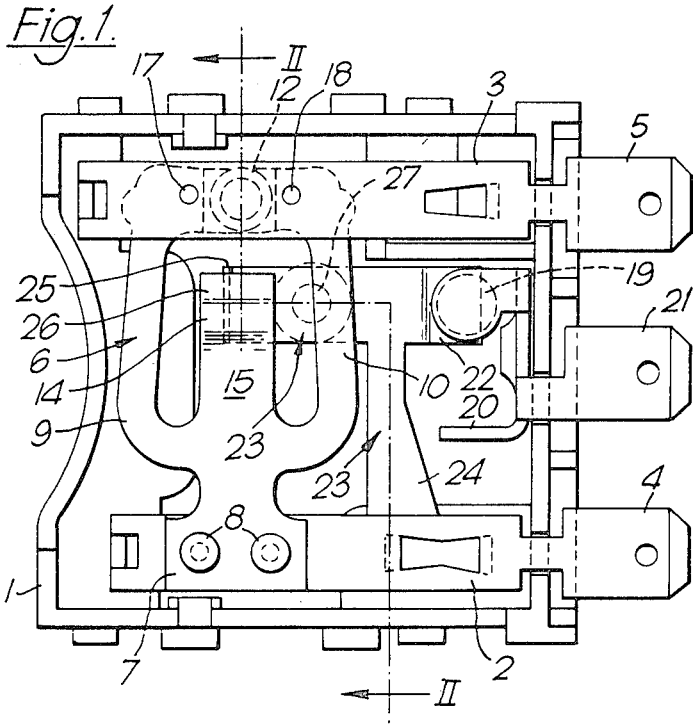

This invention concerns improvements in or relating to electrical switch devices, with particular reference to switch devices of the kind having a movable contact carried by a snap spring element which is acted upon by an operating element to cause snap movement of the movable contact relative to a fixed contact.

In such switch devices the snap operation of the switch in a contact-opening or a contact-closing sense occurs at specific points in the travel of the switch operating element.

Normally the calibration of such a switch device, that is, the determination of the points in the travel of the switch operating element at which snap operation of the switch occurs, would be carried out by adjusting the normal rest position of the part of the snap spring element which is engaged by the switch operating element. The present invention provides, in one aspect, a simple method of calibrating such an electrical switch device. According to this aspect the invention provides a method of calibrating an electrical switch device having a support member carrying a fixed contact and a movable contact carried by a snap spring element which is acted upon by an operating element, in which the support member of the fixed contact is deformed relative to movable contact upon assembly of the switch device to predetermine the operating point of the switch contacts upon displacement of the operating element in the contact-opening direction.

By deforming the support member of the fixed contact the operating point of the switch, specifically the point in the travel of the switch operating element at which the switch contacts open, can be predetermined, without changing or adjusting the position of any part of the snap spring element. This in turn is an important practical consideration, since it means that the switch device can be assembled with the snap spring element in a fixed predetermined position, calibration being effected subsequent to assembly of the switch device by controlled deformation of the fixed contact.

The invention also comprehends a snap acting switch device comprising a fixed contact carried by a support member, a movable contact carried by a snap spring element, and an operating element acting upon the spring element, the support member of the fixed contact being rigid but deformable and having a predetermined deformation which determines the operating point of the switch contacts upon displacement of the operating element in the contact-opening direction.

Since the switch device is calibrated by deformation of the fixed contact support member it is not necessary to make provision for the adjustment of the snap spring element itself, and this, as well as simplifying the assembly of the switch device, also ensures that the position of the point of engagement with the snap spring element of the switch operating element is always the same relative to the supporting structure of the snap spring element. This in turn is an important consideration where the snap spring element is arranged to initiate operation of an auxiliary switch, since the point of operation of this switch can then be predetermined in the assembled switch device.

Thus in a preferred embodiment of the invention the snap spring element of the switch device has an operating tongue which is engageable with the operating element and which is supported cantilever fashion and which has a predetermined stable position relative to the movable contact, a part of the operating tongue being engageable with an operating lever arm of an auxiliary switch at a predetermined point in the travel of the operating tongue.

To predetermine the operating point of the auxiliary switch the latter may be provided with an operating arm having a heel of predetermined dimensions which is engageable by the operating tongue of the snap spring element: by shaping or cutting this heel to an appropriate depth it is possible to predetermine the operating point of the auxiliary switch, without changing the operating points of the snap spring element itself and the main switch contacts associated therewith.

The required deformability of the fixed contact support member may be achieved by providing apertures in the support member close to and on opposite sides of the fixed contact carried. These apertures, as well as weakening the support member to give it the desired deformability, are preferably so disposed that they assist in ventilating the space in the immediate vicinity of the fixed and movable contacts. Such ventilation has the effect of sweeping ozone away from the vicinity of the switch contacts and thereby minimising the likelihood of arcing between the contacts.

Contact ventilation apertures may alternatively, or in addition, be provided in the snap spring element carrying the movable contact, in the immediate vicinity of the movable contact: such apertures may be positioned so as to enhance the torsional or flexural resilience of the snap spring element in the vicinity of the movable contact carried thereby so as to give rise to a sliding or rocking movement of the movable contact relative to the fixed contact prior to separation of the contacts, thereby achieving a "wiping" action, which is desirable in switch contacts for the avoidance of contact welds.

In another aspect the present invention accordingly provides a snap acting switch device comprising a snap spring element carrying a movable contact which upon operation of the switch device is movable relative to a fixed contact carried by a support member, the support and/or the snap spring element being provided with apertures in the vicinity of the respective contact carried thereby for the purpose of promoting the access of air to the contact make and break zone in the immediate vicinity of the contacts.

Figure 2:
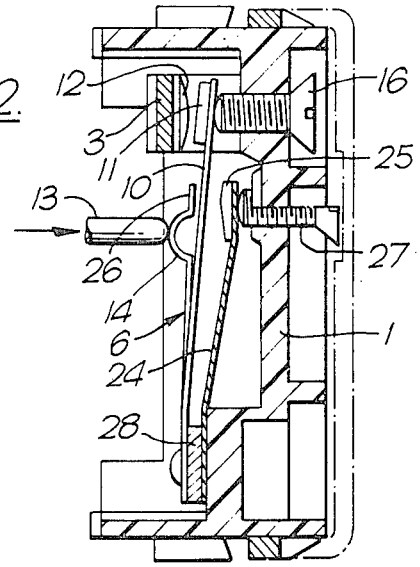

The invention will be further described, by way of example, with reference to the accompanying purely diagrammatic drawings, in which:

FIG. 1 is a plan view of a switch device according to one embodiment of the invention, and FIG. 2 is a cross-section of the switch device taken on the line II—II of FIG. 1.

The electrical switch device illustrated in the drawings has a moulded plastics base 1 in which electrically conductive metal strips 2, 3, are supported, the strips 2,3, being parallel to each other and extending along opposite sides of the base 1, each strip 2, 3, being anchored to the base 1 at two positions spaced apart along its length by upsetting and staking portions of the respective strip in appropriately positioned apertures moulded in the base 1. Each strip 2, 3, has an outwardly projecting terminal portion 4, 5, respectively.

The switch device has a snap acting switch blade 6 comprising a snap spring element projecting cantilever fashion from a tab 7 which is secured by rivets 8 to the terminal strip 2. The switch blade 6 has two projecting cantilever arms 9, 10, which at their ends remote from the anchoring tab 7 are drawn together and interconnected by a rectangular contact element 11 which constitutes a movable contact of the switch device. The contact element 11 is located beneath the terminal strip 3 in the plan view of FIG. 1 and is therefore shown in ghost outline in FIG. 1, the contact element 11 cooperating with a fixed contact 12 (FIG. 2) carried on the underside of the terminal strip 3.

The drawing together of the two cantilever arms 9, 10, of the switch blade 6 prestresses the entire blade with a dish-deformation, predisposing the blade for snap movement between configurations of opposite dish deformation. Such snap movement of the blade is effected by means of a switch operating element 13, part of which is shown diagrammatically in FIG. 2, which acts upon a raised protuberance 14 formed on a central tongue 15 of the switch blade, the tongue 15 being formed integrally with the blade and lying symmetrically between the two cantilever arms 9, 10.

In the illustrated embodiment the switch contacts are normally open (FIG. 2) the spacing between the movable contact 11 and the fixed contact 12 in the open condition being predetermined by a setting screw 16 engaged in a threaded aperture in the base 1. Closure of the switch contacts is effected by displacement of the switch operating element 13 in the direction indicated by the arrow in FIG. 2 to bend the central tongue 15 towards the base 1. At a predetermined point in the movement of the switch operating element 13 the deformed blade 6 reaches a point of instability, at which point the blade undergoes a snap movement towards an opposite dished configuration, in which the two cantilever arms 9, 10 bend in the opposite direction to the central tongue 15, away from the base 1, bringing the movable contact 11 into engagement with the fixed contact 12.

The switch blade 6 in the illustrated embodiment is mounted in a monostable manner, so that once operated as described above to close the switch contacts the stressing of the switch blade is such as to return the blade to its original configuration. Consequently, in this position the central tongue 15 exerts an elastic return force on the operating element 13, so that upon release of the latter the operating element 13 is moved in the opposite direction of the arrow in FIG. 2, causing the switch blade 6 to revert to its original stable configuration with a further snap movement, thereby causing rapid opening of the switch contacts.

The point at which the contacts open upon release of the switch operating element 13 is predetermined by the position of the fixed contact 12. In accordance with the present invention calibration of the switch device, that is, the predetermination of the position of the switch operating element 13 in its return movement at which the switch contacts 11, 12 open, is effected after assembly of the components of the switch device by deformation of the terminal strip 3 carrying the fixed contact 12. Such deformation is made possible by the fact that the terminal strip 3 has an unsupported portion, spaced from the base 1, between its two points of anchorage to the base 1. Furthermore, such deformation is facilitated by providing the unsupported portion of the terminal strip 3 with apertures 17, 18, punched or drilled in the strip 3 prior to its assembly with the base 1 on opposite sides of the fixed contact 12, the apertures 17, 18, being located on the longitudinal centre line of the strip 3.

Upon assembly of the switch device the terminal strip 2 with the switch blade 6 riveted thereto is first placed in position on the base 1, and the second terminal strip 3 carrying the fixed contact 12 is then placed in position so that the fixed contact 12 lies over the movable contact 11 carried by the switch blade 6. After securing the two terminal strips 2, 3, in position on the base 1 the unsupported region of the terminal strip 3 carrying the fixed contact 12 is deformed towards the base 1 by a suitable calibrating tool until the desired switch operating point is reached.

The apertures 17, 18, in the terminal strip 3, as well as facilitating the deformation of the fixed contact support constituted by the terminal strip 3, also act as ventilation holes promoting the flow of air between the contacts 11 and 12, and thereby removing ozone which would otherwise accumulate in the region of the two contacts 11, 12, and which could promote the establishment of an arc between the contacts when the switch opens. By ventilating the space in the immediate vicinity of the contacts 11, 12, the apertures 17, 18, in effect allow the air around the contacts to be changed after each make and break of the contacts. The apertures 17, 18, during the movement of the contact 11 away from the fixed contact 12, create a blowing effect which promotes a flow of fresh air and helps to extinguish the arc which may form between the contacts when opening the switch under electrical load conditions.

Since the cantilever-mounted switch blade 6 is supported in a fixed position relative to the base 1 the rest position of the central operating tongue 15 is also predetermined relative to the base 1. This is an important advantage as regards the calibration of an auxiliary switch, one form of which is illustrated in FIGS. 1 and 2. The auxiliary switch in the illustrated embodiment has a fixed contact 19 carried by a support member 20 fixed to the base 1 and formed with an outwardly projecting terminal portion 21. The contact 19 cooperates with a movable contact 22 carried at one end of a transverse arm of a T-shaped switch blade 23 which is supported cantilever fashion from the base 1 by a flexible support arm 24 constituting the stem or trunk of the T-shaped blade 23. The other end of the lateral arm or cross piece of the T-shaped blade 23 is bent at right angles to the said arm to form an upstanding heel 25 which cooperates with a flat end portion 26 of the central operating tongue 15 of the main switch blade 6.

An auxiliary switch setting screw 27 screwed into the base 1 engages the cross arm of the T-shaped auxiliary switch blade 23 between the operating heel 25 and the contact 22, providing a fulcrum for the auxiliary switch blade.

In the embodiment illustrated in the drawings the movable contact 22 of the auxiliary switch blade is arranged beneath the fixed contact 19 in the plan view of FIG. 1. With this arrangement, the auxiliary switch contacts 19, 22 are normally open and are closed upon pivotal movement of the auxiliary switch blade about the fulcrum screw 27, such pivotal movement being caused by engagement of the flat end portion 26 of the central tongue 25 of the main switch blade 9 with the upstanding heel 25 of the auxiliary switch blade, as a result of an excursion of the switch operating element 13 in the direction indicated by the arrow in FIG. 2 beyond the normal excursion which closes the main switch contacts 11, 12. In a temperature sensing or thermostatic switch unit such as excursion of the switch operating element 13 would result from the sensing of an excessively high temperature, for example, the temperature in a freezer or refrigerator in the event of compressor motor failure. For such an application the closure of the auxiliary switch contacts 19, 22 could be utilised to operate a lamp to signal the motor failure.

The operating point of the auxiliary switch contacts, that is, the point in the excursion of the switch operating element 13 at which the auxiliary switch contacts 19, 22, are closed, can be predetermined by cutting or shaping the operating heel 25 of the auxiliary switch blade to an appropriate depth, thereby enabling the adjustable fulcrum afforded by the screw 27 to be replaced by a fixed fulcrum if desired.

Although the illustrated version of the auxiliary switch is a normally open switch, the auxiliary switch could alternatively be arranged so that its contacts were normally closed, by simply inserting an alternative fixed contact support 20 in which the fixed contact 19 is normally positioned below the movable contact 22 of the auxiliary switch blade, rather than above the contact 22 as in the embodiment of FIG. 1. Alternatively, two different types of auxiliary switch blade 23 may be employed in conjunction with a single fixed contact 19 according to whether the auxiliary switch contacts are to be normally open or normally closed: in this case, the auxiliary switch blade 23 would have a cranked end carrying the movable contact 22, this cranked end lying beneath the fixed contact 19, as in the embodiment illustrated in FIG. 1, for a normally open auxiliary switch, and above the fixed contact 19 for normally closed auxiliary contacts.

The resilient stem portion 24 of the T-shaped auxiliary switch blade 23 serves the following purposes: (a) it acts as a return spring maintaining the auxiliary switch contacts 19, 22 normally open or closed, according to requirements; (b) it acts as a torsion spring biassing the moving contact 22. In addition, the resilient cross-piece of the T-shaped blade 23 permits, by virtue of its flexibility and the location of the fulcrum 27, overtravel of the tongue 15 once the auxiliary contacts 19, 22 are closed. Current is supplied to the movable contact 22 of the auxiliary switch blade through the stem portion 24 which is in electrical contact with the terminal strip 2 through a metal spacer element 28 (FIG. 2).

We claim:

1. A snap acting switch device comprising a base, a fixed contact carried by a support member anchored to said base, a movable contact carried by a snap spring element, and an operating element acting upon the spring element, said support member being rigid but deformable, and comprising a terminal strip anchored to the base at two spaced apart positions between which the said strip is unsupported and deformable, said fixed contact carried by the said unsupported part of the terminal strip, and said unsupported part of the terminal strip having a predetermined deformation which determines the operating point of the switch contacts upon displacement of the operating element in the contact-opening direction.

2. A switch device as claimed in claim 1, wherein the snap spring element has an operating tongue which is engageable by the operating element and a mounting tongue by which the blade is supported cantilever fashion, said operating tongue having a predetermined stable position relative to the movable contact, a part of the operating tongue being engageable with an operating lever arm of an auxiliary switch at a predetermined point in the travel of the operating tongue.

3. A switch device as claimed in claim 2, wherein the operating tongue has a free end and said part which is engageable with the auxiliary switch operating arm is located at said free end.

4. A switch device as claimed in claim 2, wherein the operating lever arm of the auxiliary switch has a heel of predetermined dimensions which is engageable by the operating tongue of the snap spring element.

5. A switch device as claimed in claim 1, wherein the support member for the fixed contact is provided with apertures close to and on opposite sides of the fixed contact, said apertures assisting in ventilating the immediate vicinity of the fixed and movable contacts.

6. A switch device as claimed in claim 1, wherein contact ventilation apertures are provided in the snap spring element in the vicinity of the movable contact carried thereby.

7. A switch device as claimed in claim 6, wherein said contact ventilation apertures are so positioned to enhance the torsional or flexural resilience of the snap spring element in the vicinity of the movable contact carried thereby, thereby causing sliding or rocking movement of the movable contact relative to the fixed contact prior to separation of said contacts.

8. A snap acting switch device comprising a supporting base defining an opening along one side, a fixed contact carried by a contact support member adjacent said opening, a movable contact, a snap spring element supporting said movable contact for movement into and away from engagement with said fixed contact, and an operating element acting upon said snap spring element for effecting movement thereof, said contact support member anchored to said base at two spaced apart locations and defining an unsupported contact carrying section extending between said locations, said contact carrying section defining passages extending therethrough adjacent opposite sides of said fixed contact, said passages effective to enable yielding deformation of said contact carrying section to determine the operating point of the switch contacts and to establish a flow path for air adjacent said contacts for ventilating the region adjacent the contacts.

* * * * *